US011387541B2

(12) United States Patent
La Cono et al.

(10) Patent No.: US 11,387,541 B2
(45) Date of Patent: Jul. 12, 2022

(54) MANUFACTURING METHOD OF A REAR WINDOW FOR VEHICLES PROVIDED WITH A HEATER-INTEGRATED ANTENNA

(71) Applicant: ASK INDUSTRIES SOCIETA' PER AZIONI, Monte San Vito (IT)

(72) Inventors: Gianluca La Cono, Reggio Emilia (IT); Andrea Notari, Viano (IT); Tiziano Nili, Reggio Emilia (IT); Luca Larcher, Reggio Emilia (IT); Paolo Lugli, Bolzano (IT)

( * ) Notice: Subject to any disclaimer, the term of this patent is extended or adjusted under 35 U.S.C. 154(b) by 0 days.

(21) Appl. No.: 16/966,121

(22) PCT Filed: Mar. 17, 2020

(86) PCT No.: PCT/EP2020/057191
§ 371 (c)(1),
(2) Date: Jul. 30, 2020

(87) PCT Pub. No.: WO2020/187872
PCT Pub. Date: Sep. 24, 2020

(65) Prior Publication Data

US 2021/0273312 A1 Sep. 2, 2021

(30) Foreign Application Priority Data

Mar. 18, 2019 (IT) ..... 102019000003881

(51) Int. Cl.
*H01Q 1/12* (2006.01)
*H01Q 1/36* (2006.01)
*H05B 3/86* (2006.01)

(52) U.S. Cl.
CPC ..... *H01Q 1/1278* (2013.01); *H01Q 1/368* (2013.01); *H05B 3/86* (2013.01)

(58) Field of Classification Search
CPC .... H01Q 1/1278; H01Q 1/368; H01Q 1/1271; H01Q 1/364; H01Q 1/12; H01Q 1/36; H05B 3/86
See application file for complete search history.

(56) References Cited

U.S. PATENT DOCUMENTS 5,097,270 A * 3/1992 Lindenmeier ..... H01Q 1/1271 343/704
5,231,410 A * 7/1993 Murakami ..... H01Q 1/1278 343/704

(Continued)

FOREIGN PATENT DOCUMENTS

DE 4034548 A1 5/1992
EP 1502321 B1 12/2010

OTHER PUBLICATIONS

International Search Report for corresponding PCT/EP2020/057191, dated Jun. 15, 2020.

(Continued)

*Primary Examiner* — Andrea Lindgren Baltzell
*Assistant Examiner* — Yonchan J Kim
(74) *Attorney, Agent, or Firm* — Egbert, McDaniel & Swartz, PLLC

(57) ABSTRACT

A manufacturing process of a rear window for vehicles including the following steps: provision of a glass plate with an external side suitable for being directed towards the exterior of the vehicle and an internal side suitable for being directed towards the interior of the vehicle; application of a heater on the internal side of the glass plate, the heater having two bus bars that are electrically connected to a positive pole and to a negative pole of a battery of the vehicle, respectively, and a plurality of horizontal heating lines that connect the bus bars; and application of antenna traces on the internal side of the glass plate, wherein the antenna traces have strips of transparent nanowires made of (Continued)

conductive material. The application of the antenna traces is made by spray-coating on the internal side of the glass plate.

16 Claims, 13 Drawing Sheets

(56) References Cited

U.S. PATENT DOCUMENTS

| | | | | |
|---|---|---|---|---|
| 5,952,977 | A | 9/1999 | Taniguchi et al. | |
| 6,002,373 | A | 12/1999 | Taniguchi et al. | |
| 9,231,213 | B2 | 1/2016 | Song et al. | |
| 2008/0028697 | A1* | 2/2008 | Li | B32B 27/08 52/171.2 |
| 2014/0158987 | A1* | 6/2014 | Song | H01Q 9/0407 257/29 |
| 2016/0134008 | A1* | 5/2016 | Kim | H01Q 1/1271 343/711 |
| 2016/0374150 | A1* | 12/2016 | Guillaume | H05B 3/86 |
| 2018/0192477 | A1* | 7/2018 | Klein | H03K 17/962 |
| 2020/0037401 | A1* | 1/2020 | Chi | H05B 3/06 |

OTHER PUBLICATIONS

Written Opinion of the International Searching Authority for corresponding PCT/EP2020/057191, dated Jun. 15, 2020.

* cited by examiner

MANUFACTURING METHOD OF A REAR WINDOW FOR VEHICLES PROVIDED WITH A HEATER-INTEGRATED ANTENNA

The present invention relates to the automotive sector and in particular to a manufacturing method of a rear window provided with a heater-integrated antenna.

Heaters are used in the automotive sector to defrost and defog the rear window of a vehicle. Vehicle antennas are realized with the same technology used by rear window manufacturers to make heaters. Such a technology consists in realizing a grid of copper or silver-based conductive screen-printed lines on a glass plate according to a mask. The screen-printed glass plate is annealed and tempered in the oven to guarantee the hardening and the strength of said screen-printed plate.

In order to defog and defrost a rear window provided with heater, a battery voltage is applied between the two rheophores of bus bars disposed at the right end and at the left end of the rear window. The bus bars are connected to conductive wires that horizontally cross the rear window from the right to the left.

Because of the application of voltage, a current flows in the heater from a bus bar connected to the positive pole of the battery towards another bus bar connected to the negative pole, being divided in parallel in each one of the horizontal lines of the heater that are joined to the bus bars. By flowing in each horizontal branch of the heater, the current heats the internal side of the glass and defogs the glass. The uniformity and rapidity of defogging depend on the uniformity of the voltage drop along each horizontal line of the heater, between the bus bar connected to the positive pole of the battery and the bus bar connected to the negative pole of the battery.

Generally speaking, rear window manufacturers design a layout of the heater in such a way to optimize the current distribution in all the horizontal lines of the heater and make the current distribution as uniform as possible in each line, while trying to reduce the number of screen-printed heating lines that are necessary for defogging in order to minimize costs.

Glass manufacturers provide the elements used for glass defrosting and the elements used for the antenna in the same screen-printing mask used for the heater.

The operating elements for the antenna comprise:

- Vertical screen-printing or slightly inclined screen-printing that intersect the horizontal lines of the heater, either completely or partially. Screen-printing is used to optimize the antenna performance by improving the bandwidth or the impedance adaptation. The maximum inclination value is contained and imposed by the glass manufacturer in order not to deviate the distribution of the heating current from its path and, consequently, impair the uniformity of the defrosting action. Such a constraint is a limitation of the performance in terms of designing an antenna system that is integrated in a rear window of a vehicle. A higher inclination of the lines would provide antennas with an impedance adaptation with wider band and consequently a more uniform coverage in frequency in the band of interest.
- Antenna powering screen-printing: this screen-printing is provided at one end with a pad for the interconnection, by means of welding, with a copper unipolar terminal provided with a connector for connection with an amplifier.

In terms of operation, antenna powering screen-printing can be of different type:

- Screen-printing with coupling with the heater. It operates as a field probe that captures the useful received signal captured by the heater in a conducted or radiated way. Screen-printing with direct coupling with the heater is known, which is physically connected to the heater at the opposite end relative to the pad, as well as screen-printing with capacitive coupling with the heater. Screen-printing for capacitive coupling is not directly connected to the heater, and are provided, at the opposite end relative to the pad, with a screen-printed section that faces the closest heating line (generally at a distance from 3 to 15 mm), developing in parallel direction in order to obtain a capacitive coupling.
- Separate screen-printing that operates by means of resounding, without using the coupling with the heater. Likewise, separate screen-printing has a pad and a copper wire with a terminal in order to be connected to the amplifier.
- Stub screen-printing: it can be directly connected to the heater or disposed in the proximity of the heater, but it is never provided with a pad for the interconnection with the amplifier. It is used to optimize the antenna performance by improving the bandwidth or the impedance adaptation.

At the moment, the integration of an antenna screen-printing in a rear window of a vehicle must comply with two types of constraints:

Functional Defrosting Constraints

The antenna screen-printing that is directly connected to the heater can be realized only with a punctual contact in correspondence of the heater, as in the case of direct coupling.

In the case of extended lines, such as the ones that intersect the defrosting lines, their inclination must have a limited value. They can be perfectly vertical or slightly inclined relative to a vertical line. The reason is that they must intersect the horizontal lines only in equipotential points, otherwise the current is additionally divided in correspondence of an intersection and, by flowing along the intersection, the intensity of the current that flows along the horizontal line is reduced. This results in a lack of uniformity and in a lower defrosting efficacy of the glass in longitudinal direction. The free inclination of the lines that intersect the heating lines would result in a more uniform performance in the bands of interest.

Moreover, the need to maintain a uniform current distribution in order to defrost the glass imposes a limitation on the possibility of realizing antenna powering screen-printing with direct or capacitive coupling, which can capture the useful signal in areas other than the areas around the heater. Otherwise said, if the useful signal that is captured by the heater is concentrated in a more internal portion of the heater, at the moment it is impossible to reach such a portion by tracing an antenna powering screen-printing that can be coupled in the proximity of the point where the intensity of the filed is higher. This reduces the efficiency of an antenna integrated in a rear window and impairs the freedom in the optimization of the layout in order to improve the performance.

Constraints Related with Ion Migration

This phenomenon occurs in correspondence of a capacitive coupling between an antenna powering screen-printing and a heater screen-printing, when the heater is powered, if the potential difference has a significant value or if the distance between the screen-printing is too short. The practical effect of the ion migration occurs when humidity, condensation or impurities (dust, metal dust, etc.) are present on the glass surface and consists in the creation of a current that flows from the horizontal line of the heater, which is energized, at a potential different from zero, towards the antenna powering screen-printing with capacitive coupling. The current density is very intense and causes the overheating of the antenna traces by Joule effect, causing its evaporation with consequent destruction of the screen-printed layout of the glass. In order to remedy such a drawback, a minimum safety distance is currently imposed for the capacitive coupling, which varies from 8 mm to 18 mm, according to the specific case and to the automotive manufacturer, well beyond the processing limits of glass manufacturers that could produce screen-printing with a distance lower than 5 mm, improving the efficiency of the capacitive coupling and the intensity of the captured signal.

Functional Visual Constraints

The layout of the heating screen-printing is evaluated in terms of visual impact for the vehicle's driver. Such a layout must be made in such a way that the lines do not hinder the rear vision of the obstacles that are encountered during maneuvers. In general, automotive manufacturers tend to leave the central portion of the rear window free, avoiding the provision of lines in the center or around the central region of the glass.

Aesthetic Constraints

Being visible from the outside, automotive manufacturers consider the rear window of a vehicle as an aesthetic part of the vehicle that must be approved by the design department. In particular, the design of the lines of the rear window must comply with aesthetic rules and automotive manufacturers sometimes modify the layout of the antenna traces, in spite of the fact that the antenna system is performing well in terms of signal reception. Typically, for aesthetic reasons, the design of the antennas is limited in the number of vertical lines and in the shape of the antenna powering traces. In particular, the latter must aesthetically match the rear window according to the geometry of the heater. At the moment, in order to reduce the aesthetic impact caused by the presence of the antenna traces, the antenna traces are concealed in the black band region, i.e. the peripheral region of the glass, which is internally defined by the central transparent portion of the glass and is externally defined by the adhesion area between the rear window and the body of the vehicle door. The traces are deposited on the black band, which has covering properties, in such a way that they are not visible from the outside. However, this is not always possible because, based on the type of vehicle, rear windows are not especially extended in vertical direction and therefore have a very small black band region, if any. In such an instance, the space available for the antenna traces is extremely small and, it being impossible to couple the antenna powering screen-printing with the internal central lines of the heater, the design is complicated and the performance is reduced.

U.S. Pat. No. 5,952,977 discloses a solution to improve the rear visibility through the rear window, which is impaired by the use of a vertical line that is disposed in the central region of the glass. Such a vertical line provides a better performance in terms of reception, but reduces the rear visibility, being exactly positioned in the visual trajectory of the driver. In order to solve this problem and maintain a high performance level, U.S. Pat. No. 5,952,977 proposes a system with two vertical lines situated at the sides of the central region of the rear window, which intersect all the horizontal heating lines and are extended on top of the heater to form a "T" that is coupled with capacitive couplings with the antenna powering screen-printing. Each vertical line is connected, towards the receiver or towards the amplifier disposed in intermediate position, with a pad and a unipolar wire. Several variants of said capacitive couplings between the vertical lines of the heater and the antenna powering screen-printing are proposed. However, although the central region of the rear window is left advantageously empty, improving the rear vision, such a solution is impaired by the complexity of the powering lines and of the capacitive couplings, with a negative effect on the aesthetics. This is especially detrimental for automotive manufacturers and implies some limitations on possible applications. Another drawback is experienced when such a solution is applied in rear windows wherein the region without the heater, between its perimeter and the region for gluing/overlapping to the metal door/car body, is small. In such a case, no sufficient space is available for said couplings.

EP1502321 discloses an antenna trace layout in the heater composed of a set of vertical sections disposed in a step pattern perpendicularly to the horizontal heating lines. Each vertical section is in contact with a pair of horizontal heating lines. Advantageously, more directive radiation diagrams are obtained with such a solution because of the special distribution of signal current useful for radio reception that derives from the vertical section array, without altering the distribution of heating current for defogging and defrosting the rear window. This is because the vertical sections of the antenna connect a pair of horizontal lines between two equipotential points and therefore the direct current with heating function flows along each horizontal line, and not through the vertical sections. Such a solution is impaired by the provision of a plurality of vertical sections distributed for the entire width and height of the heater, including the central region of the rear window. Consequently, the impact of said vertical sections can be critical for the driver in terms of rear vision, compared with the presence of two traditional simple continuous vertical lines disposed in the central region of the rear window. Moreover, the aesthetic impact of a step pattern of the heater, which is more irregular than a traditional one, is not appreciated by automotive manufacturers, who tend to prefer shapes and patterns that are clean, simple and regular.

U.S. Pat. No. 9,231,213B2 discloses a system that provides for the integration of electric components, antennas and RF circuits in a single transparent platform (glass). A spray-coated film of silver nanowires (AgNWs) is used as transparent conductive film for the realization of antennas or interconnections for passive components, such as resistors, capacitors and inducers. Moreover, graphene is used as active channel for the realization of RF devices (switches, amplifiers and the like). Moreover, a method called "local selective conductor control method" is assessed, which provides for the controlled deposition of nanomaterial layers in the areas wherein a higher conductivity is necessary in detriment of transparency. Antennas are a separate element and are not integrated with the heaters; the antenna layout is generic and does not have any peculiar elements (slot antennas that are powered with coplanar structures). For the dielectric layers of capacitors, the deposition of materials such as SiNX (silicon nitride) or HfO2 (hafnium oxide) is considered. The oxide deposition technology is not specified.

US2016/0134008 discloses a rear window for vehicles comprising a mesh grid obtained by means of the deposition of transparent conductive nanowires (AgNW, ITO, CNT) on a glass plate. Such a grid can be part of an antenna or a heating element. The deposition of a grid of transparent nanowires is a complicated process. US2016/0134008 suggests the use of a transparent adhesive layer to isolate two conductive traces on different levels. Moreover, the application of the adhesive layer is inaccurate and complicated.

The purpose of the present invention is to eliminate the drawbacks of the prior art by disclosing a manufacturing process of a rear window provided with a heater-integrated antenna, wherein the antenna screen-printing is transparent and does not impair the aesthetics of the rear window and the visibility for the driver.

Another purpose is to disclose such a manufacturing process of a rear window, wherein the antenna has a high performance in terms of band and impedance, and at the same time does not interfere with the efficiency of the heater integrated in the rear window.

These purposes are achieved according to the invention with the characteristics of the independent claim 1.

Advantageous embodiments of the invention appear from the dependent claims.

In view of the above, in order to overcome the limitations of the prior art and the constraints for the design and the performance of rear window-integrated antennas, the following conditions should apply:

1. The additional screen-printing of the heater that operates as antenna should be transparent and invisible, in such a way to have no impact on aesthetics and vision, regardless of the size of the rear window and of the available space without the lines of the heater.

2. The screen-printing for the coupling and powering of the antenna should be isolated in order to be brought in the proximity of internal and central regions of the heater, in such a way to intercept the regions where the fields of the received signal are more intense, without electric contact with the layout of the heater, thus avoiding to alter the distribution of current that is necessary to defrost the glass.

3. High-impedance vertical lines in direct current (DC) should be realized to prevent the current used for defogging from deviating from its ordinary path along a horizontal heating line, in order to enjoy a higher freedom in terms of geometry of the antenna screen-printing that intersects the horizontal heating lines.

These results can be obtained by depositing electrically insulating dielectric layers on the internal side of the rear window, whereon conductive lines made of nano-materials (copper, silver, and carbon-based nanomaterials) are deposited, operating as antenna and being intrinsically highly transparent and therefore invisible.

Several nano-materials can be considered for the realization of the transparent antenna traces. Examples can be silver nanowires (AgNWs), copper nanowires (CuNWs), PEDOT:PSS, and carbon nanotubes (CNT). These nanomaterials can be deposited by means of the realization of transparent conductive films, with different technologies such as drop melting, meyer-rod coating, vacuum filtration, spin coating and spray coating. The spray-coating technology is preferably chosen because it is flexible, scalable and inexpensive.

A solution for deposition is obtained with a suitable process according to the material used. For example, with reference to silver nanowires (AgNW), 1 g of AgNW solution is diluted with 14 g of isopropyl alcohol and 5 g of deionized water (DI) and is then agitated. Likewise, 1 g of PEDOT:PSS is diluted in 4 g of DI water.

Successively, 10 mg of Dynol 604 agent and 200 mg of ethylene glycol (EG) are added to improve conductivity. Then the solution is sonicated for 30 seconds to disperse the agglomerates.

The CNT base solution is composed of DI water, 90% semiconductor CNT and sodium dodecyl sulphate (SDS) that acts as dispersion agent. 1% in weight of SDS is dissolved in DI water and 0.03% in weight of CNT is added. The solution is treated with a sonicator for 25 minutes with 50% power and is centrifuged at 15 krpm for 90 minutes and the 80% of surnatant is separated in order to be used as CNT ink.

For the realization of copper nanowire ink, 300 mg of hydrochloride copper are immersed in 25 g of distilled water and sonicated for 5 minutes. Then, 900 mg of oleylamine are added and the solution is sonicated for 60 at 200 W.

Successively 300 mg of L-Ascorbic acid dissolved in 5 g of DI water are added. The solution is let for 12 hours in a silicon oil bath at a calibrated temperature of 81° C.

With reference to FIG. 1, the spray-coating technology uses a completely automated system to realize films that are thin, reproducible, homogeneous, scalable, inexpensive and provided with a low substrate temperature. Such a system comprises a spraying nozzle (N) and a heated plate (P) whereon a substrate (S) is positioned. The spray-coating technology requires to control several parameters simultaneously, such as spraying pressure, flow rate, scanning speed, height (distance (D) between nozzle and substrate) and temperature of substrate (S). A specific form of the sprayed material can be obtained by using (plastic or metal) masks that cover the substrate portion whereon the material is not to be deposited, and do not cover the portions where the functional layer is to be deposited.

Advantageously, a cleaning treatment with oxygen and plasma can be performed before the spray-coating of the substrate (S), in order to make the surface of the substrate more hydrophilic, improving the wettability properties and the formation of the film on the active substrate. The time of the cleaning treatment varies according to the type of material: if the passive substrate is glass, the oxygen-plasma cleaning treatment is performed for 1 minute.

Figure 4:
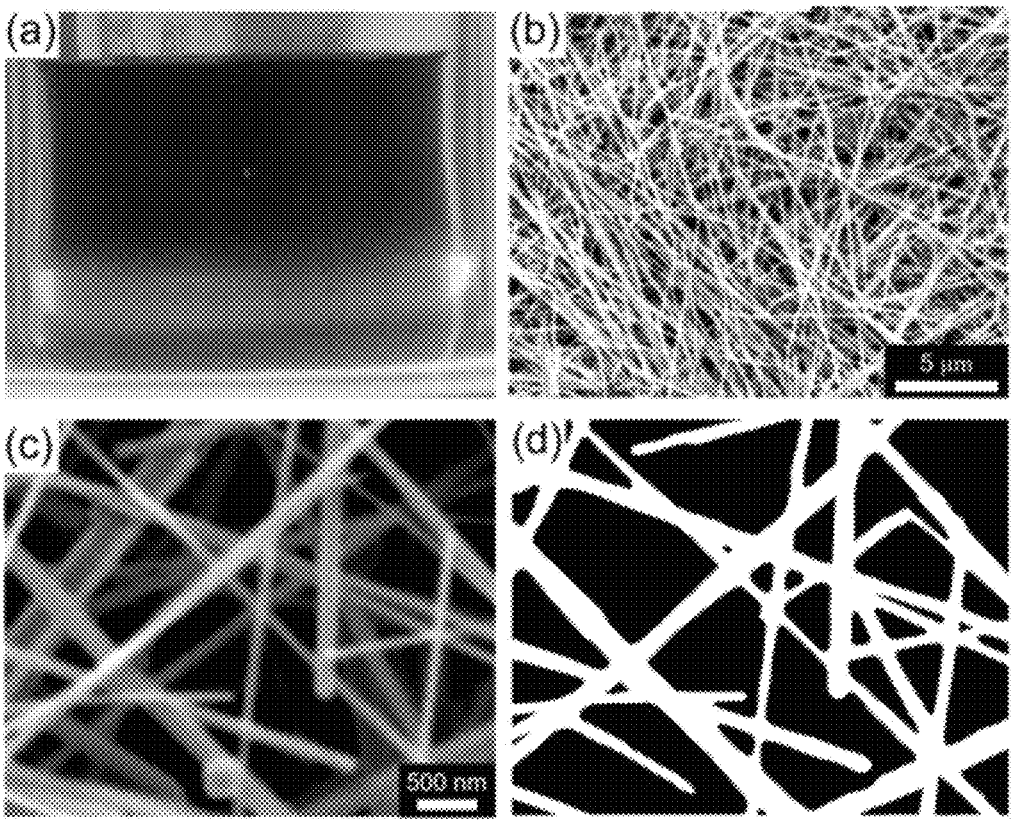
Figure 4E:
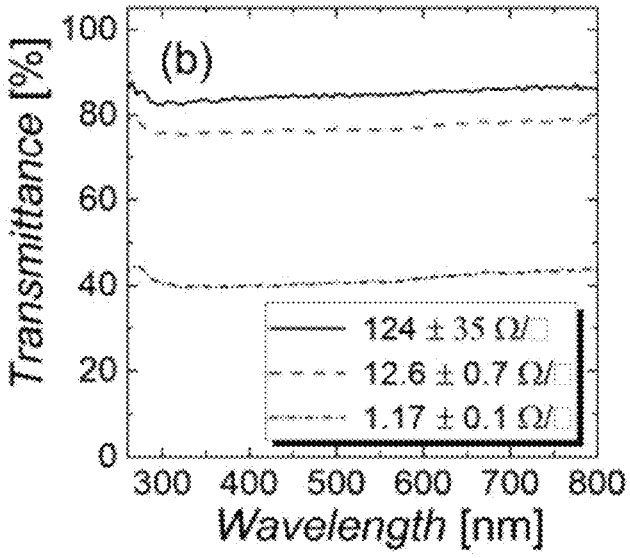

FIG. 4(A) shows a synthesized solution of copper nanowires (CuNW). FIGS. 4(*b*) and 4(*c*) are SEM images of copper nanowires at low and high enlargement. FIG. 4(D) is a conversion of binary images for determining the diameter of a wire of the layer of copper nanowires. FIG. 4E illustrates the transmittance spectra for CuNW films by increasing wire density.

An advantage of this process consists in the possibility to control the thickness of the deposited element as result of an addition of the previously deposited thin layers. Considering that the optical absorption of a thin film increases exponentially with thickness (Beer-Lambert law), an accurate control of the thickness is fundamental to obtain semi-transparent layers. Moreover, this approach improves the reproducibility of the sample because the formation of the deposited element is performed in multiple identical events and therefore the onset of impurities generated during an individual deposition event is reduced. The temperature of the substrate is 50° C., the pulverization pressure in the spraying nozzle is 0.05 Mpa, the pressure of the dispersion sprayed on the passive substrate is 0.02 MPa, the deposition speed is 250 mm/s, the distance (D) between nozzle and substrate is 3 mm.

In view of its versatility the spray-coating technology can be also used to obtain insulating layers. Insulating transparent polymers, such as Polymethylmethacrylate (PMMA), dissolved in solution and metal oxides in sol-gel form (the most used ones being aluminum and titanium oxide sol-gels) can be atomized and deposited by means of said spray-coating technology. The realization of thin layers made of these materials, which are characterized by transparency and low conductivity, permits to isolate several metal layers, avoiding any contact.

After the deposition of each material, a step of thermal or optical treatment of the substrate must be performed (UV pulsed light or IR light) to cause the evaporation of the solvent and the dissolution of the dispersion materials (in the case of metal nanowires), the achievement of a better order of the polymeric chains (in case of conductive insulating polymers) or the drying of the gel (in the case of sol-gels).

According to the aforementioned description, the realization of a rear window is obtained by depositing the various functional materials with suitable masks, one on top of the other. In particular, the process comprises the following steps 1. Preparation of a printing ink with transparent nanowires;
2. Preparation of a transparent dielectric substrate (cleaning and plasma activation, if any);
3. Positioning and alignment of a screen-printing mask;
4. Spray-coating of the printing ink;
5. Thermal or optical post-treatment of the substrate These steps are reiterated for every material. In case of integration of heating lines and conductive lines that are dedicated to the antenna, the entire process will be reiterated at least three times; in particular, the process will be:

a. Steps 1 to 5 for the deposition of the conductive heating lines (thickness between 30 nm and 500 nm according to the nanomaterial used and the transparency level)

b. Steps 1 to 5 for the deposition of the electrically insulating material (thickness between 100 nm and 10 micron according to the electric insulation and the transparency level)

c. Steps 1 to 5 for the deposition of the conductive lines for the antenna. The material used in this step is not necessarily the same material used in step a. (the selection of the material and of the thickness is determined by the desired impedance).

The aforementioned technology can be applied to a rear window of a vehicle to obtain a heater-integrated antenna. The overall result is a rear window-integrated antenna system, just like the traditional systems. However, the rear window of the invention overcomes the limitations of the rear windows of the prior art because it has zero aesthetic impact of the antenna lines and provides a higher versatility during the design stage because it permits electromagnetic couplings of the antenna traces with more internal regions of the heater, and generally speaking, geometries and solutions that are not permitted in the prior art.

The new types of couplings and screen-printing for the antenna area:

- Direct couplings with horizontal lines other than the first line on top or the last line on the bottom.
- Capacitive couplings with horizontal lines other than the first line on top or the last line on the bottom.
- Capacitive couplings with horizontal lines with increased proximity with the lines of the heater. The presence of the oxide deposition electrically insulates proximal couplings that are normally subject to ion migration.
- New overlapped capacitive couplings wherein, instead of being coplanar to the surface of the heater, normally situated above the horizontal heating scree-printing by a few millimeters, the antenna powering screen-printing can be overlapped at the same height as the heating screen-printing and can be capacitively coupled in transverse direction because of the only presence of the oxide layer in intermediate position, creating a capacitive coupling with almost zero gap, and therefore with high intensity.
- New extended direct couplings. By using a deposition of nanowires with controlled high impedance value, an extended direct coupling band is created, instead of a punctual coupling (more limited band).
- High-impedance intersecting screen-printing with high inclination value relative to the vertical direction and lower interference with the current paths imposed for the horizontal heating lines.
- Antenna powering scree-printing with direct or capacitive couplings, which include concentrated planar structures obtained by means of spray coating of copper nanowires (or silver nanowires), which are transparent, and oxide layers, which are insulating, to obtain capacitive or inductive elements according to the specific requirements, impedance adapters at the desired frequencies.
- Stud adaptation screen-printing that can be applied to horizontal lines other than the first line on top or the last line on the bottom.
- Antenna system layouts in view of the transparency introduced by the nanowires used for the traces, with a higher number of vertical lines in more central positions of the rear window, which are currently not possible.
- Possibility of extending the transparency of the screen-printing also to the heating lines, in such a way to considerably improve the rear vision for the driver.

Figure 1:
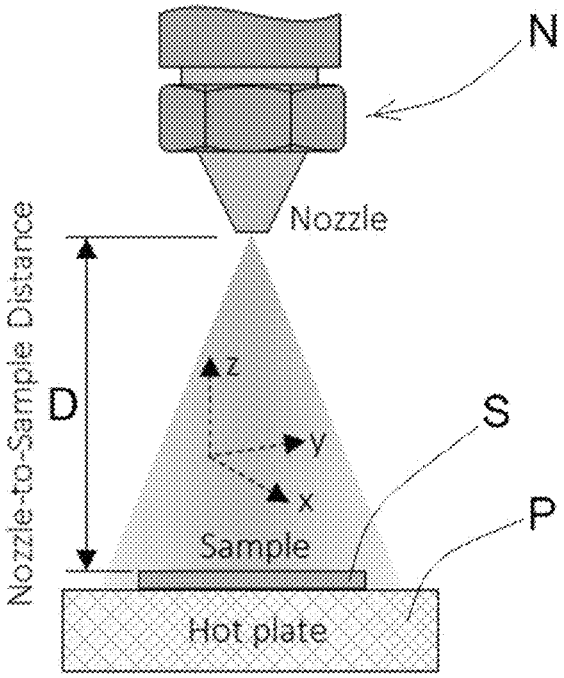
Figure 2:
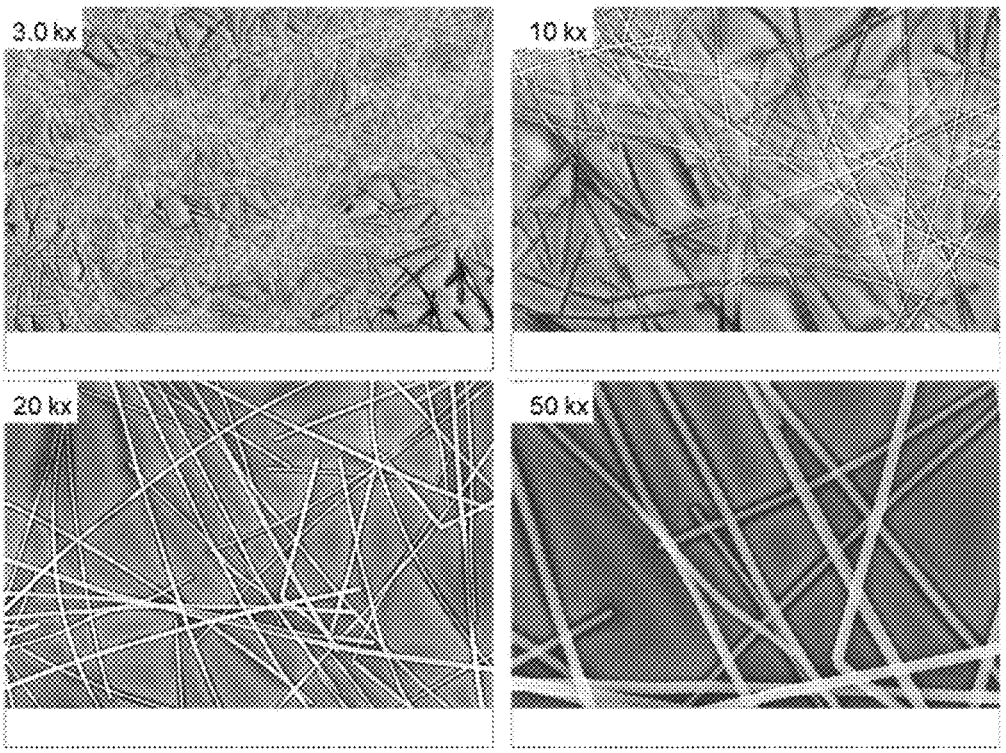
FIG. 2 illustrates the morphology of silver nanowires (AgNW) deposited in five layers on the substrate (S).
Figure 3:
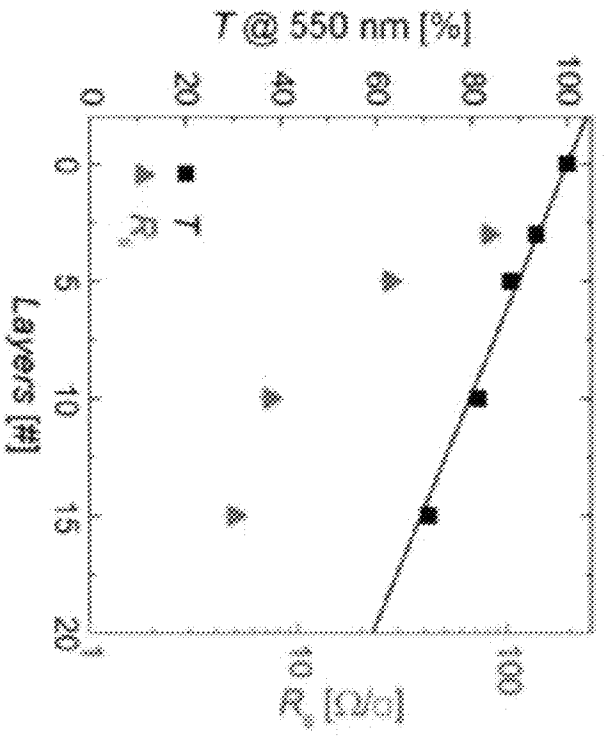
FIG. 3 illustrates the transmission of the AgNW film according to the number of layers.
Figure 5:
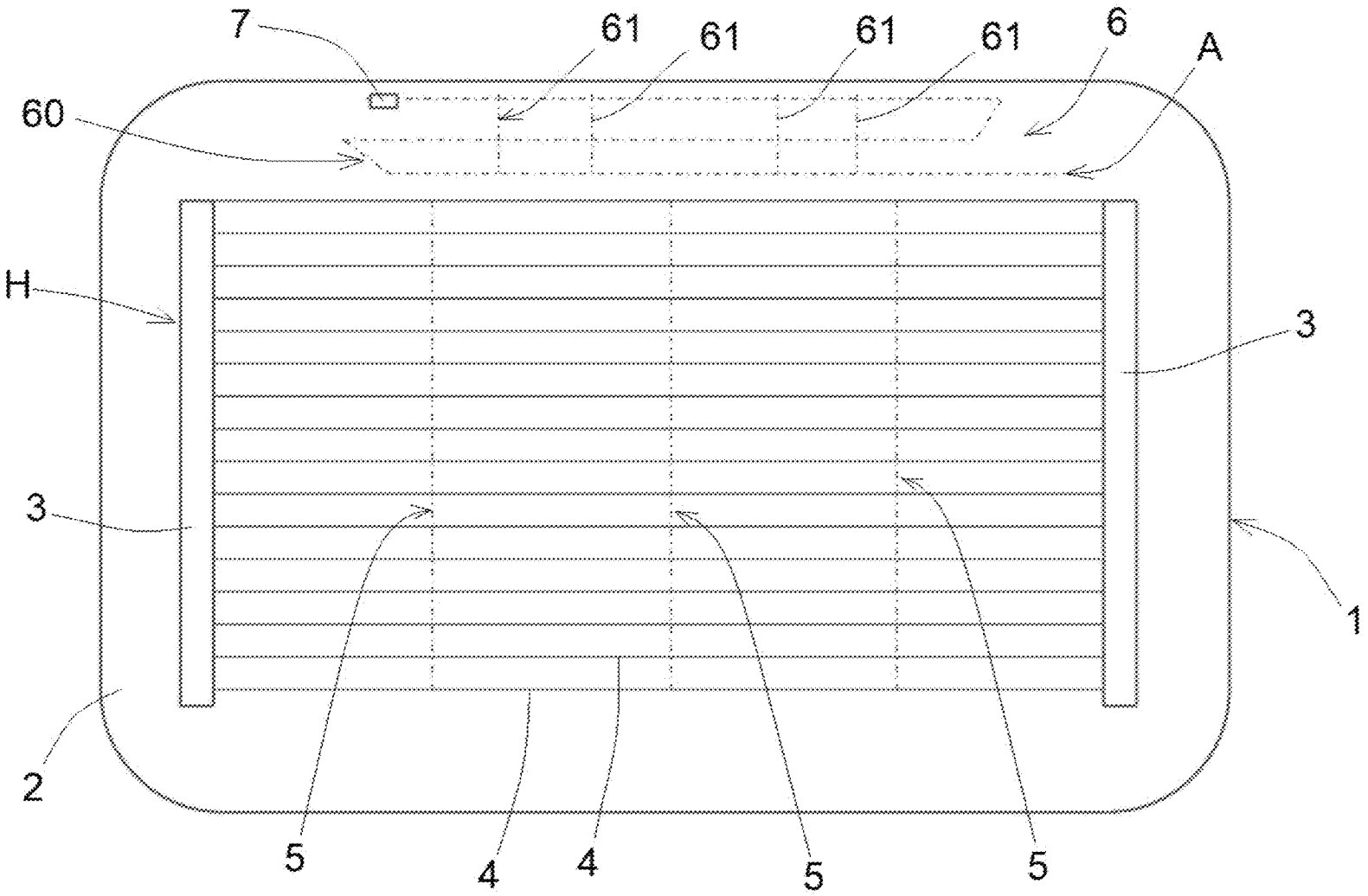
Figure 9:
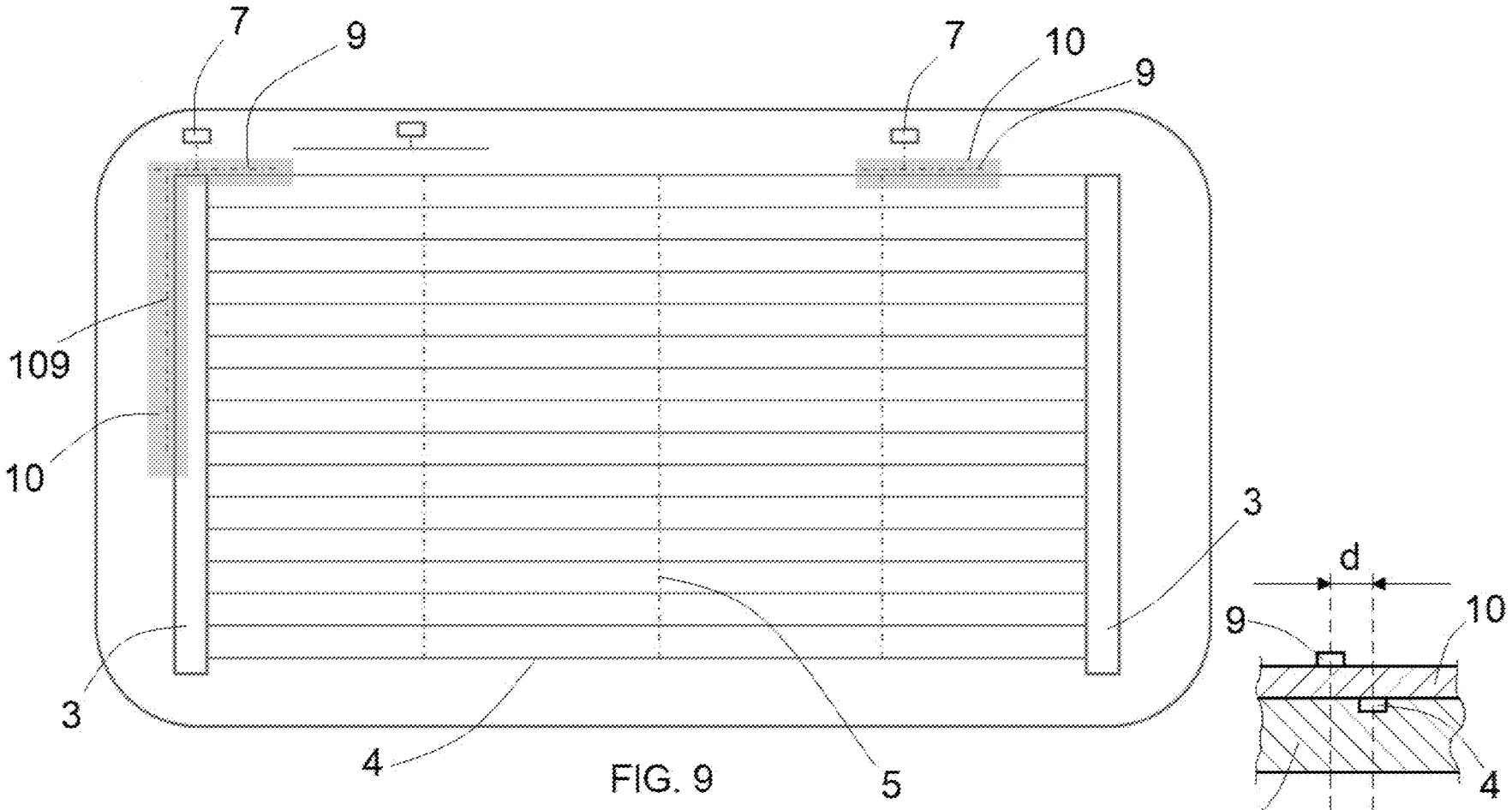
Figure 10A:
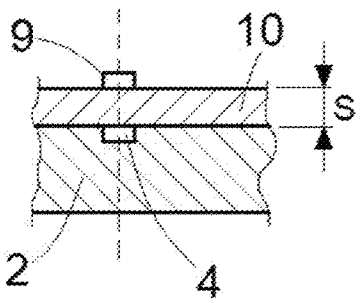
Figure 10:
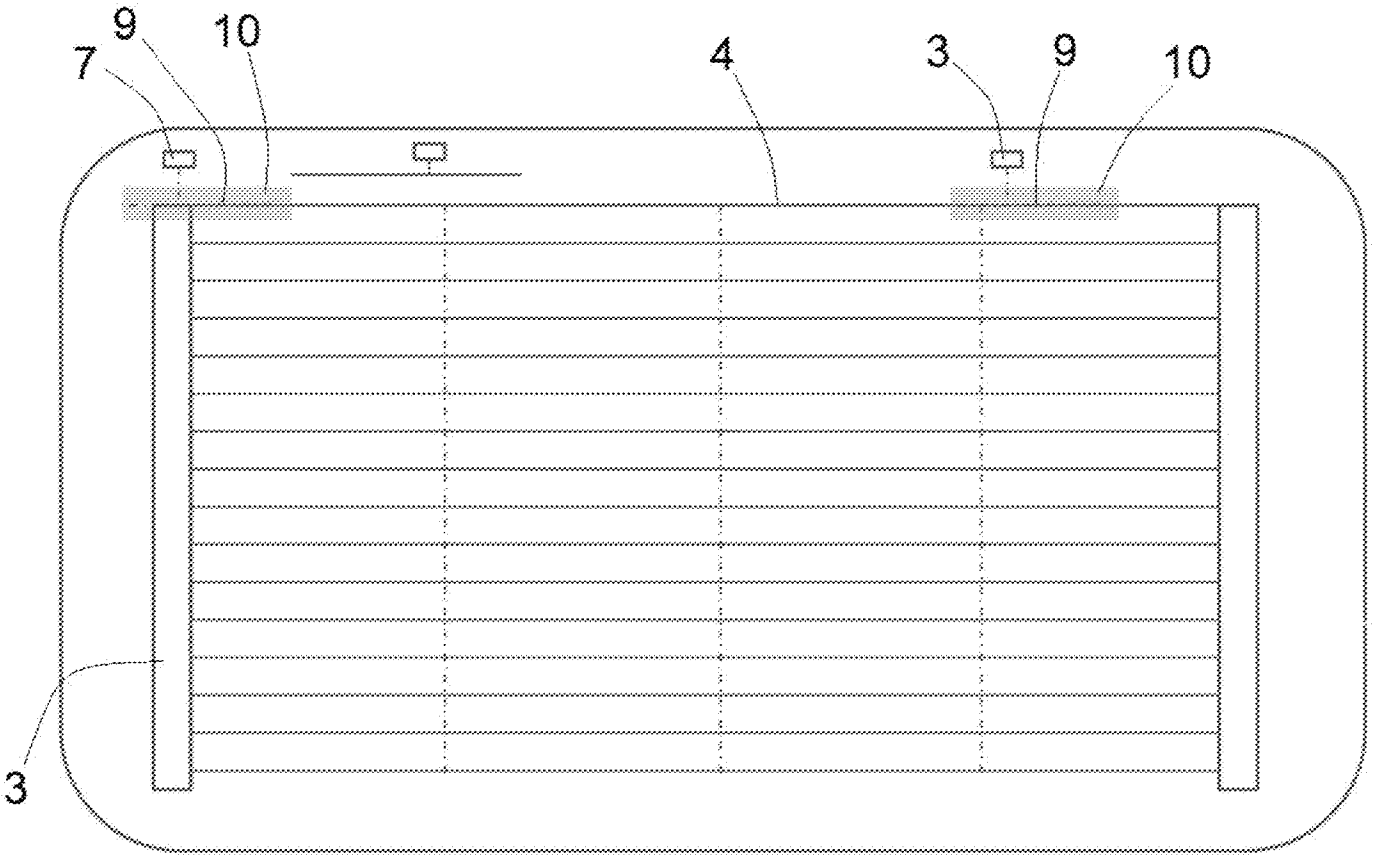
Figure 13A:
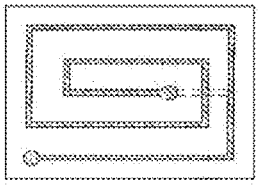
Figure 13B:
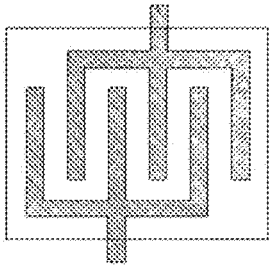
Figure 13C:
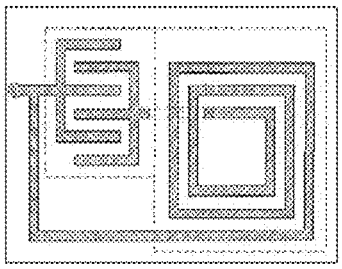

Additional features of the invention will be clearer from the following detailed description, which refers to merely illustrative, not limiting embodiments, as shown in the appended figures, wherein:

FIG. 1 is a diagrammatic view of a nozzle for the deposition of nanowires;

FIG. 2 is an image of AgNW deposited in five layers on a substrate;

FIG. 3 illustrates the transmission of an AgNW film according to the number of layers;

FIG. 4(A) is a photograph of a synthesized solution of copper nanowires;

FIGS. 4(*b*) and 4(*c*) are SEM images of copper nanowires at low and high enlargement;

FIG. 4(*d*) is a conversion of binary images;

FIG. 4E illustrates the transmittance spectra for CuNW film by increasing wire density;

FIGS. 5 to 14 are nine diagrammatic views that illustrate nine possible embodiments of a rear window for vehicles according to the invention;

FIG. 5 is a cross-sectional view of a detail of FIG. 9;

FIG. 5 is a cross-sectional view of a detail of FIG. 10;

FIGS. 13A, 13B and 13C illustrate three different embodiments of planar adaptation structures.

With reference to FIGS. 5 to 14, the rear window of the invention is disclosed, which is generally indicated with reference numeral (1).

In the following description the terms "horizontal" and "vertical" refer to the arrangement of the lines in the Figures.

With reference to FIG. 5, the rear window (1) comprises a glass plate (2) with a substantially rectangular shape and suitable dimensions to cover a back part of the body of a vehicle.

For illustrative purposes, the glass plate (2) can be a tempered, multilayer or mono-layer glass with a thickness of approximately 5-8 mm.

The external side of the glass plate (2) is suitable for being directed towards the exterior of the vehicle and the internal side of the glass plate (2) is suitable for being directed towards the interior of the vehicle.

A heater (H) is applied on the internal side of the glass plate (2). The heater (H) comprises two bus bars (3) of conductive material that are disposed in vertical position near the lateral edges of the glass plate. The bus bars (3) are electrically connected respectively to a positive pole and to a negative pole of a battery of the vehicle, in such a way to define a potential difference between the two bus bars (3).

The bus bars (3) can be made in a traditional way, by means of screen-printing of a copper or silver conductive paste on the glass plate (2).

Advantageously, in order to obtain transparent bus bars, the bus bars (3) can be obtained by means of spray-coating of transparent nanowires on the glass plate (2), as illustrated above. For illustrative purpose, each bus bar (3) has a width of 6-30 mm, a length of 20-100 cm and a thickness of 30-50 nm obtained with the deposition of three layers of nanowires.

The bus bars (3) are connected by a plurality of horizontal heating lines (4). For instance, 16 horizontal heating lines can be provided in equally spaced parallel position.

The horizontal heating lines (4) can be made in a traditional way, by means of screen-printing of a copper or silver conductive paste on the glass plate (2).

Advantageously, in order to obtain transparent horizontal heating lines, the horizontal heating lines (4) can be obtained by means of spray-coating of transparent nanowires on the glass plate (2), as illustrated above. For illustrative purpose, each horizontal heating line (4) has a width of 1 mm, a length of 80 mm and a thickness of 10-20 nm obtained with the deposition of one layer of nanowires.

The application of a potential difference between the two bus bars (3) generates a circulation of current in the horizontal heating lines (4) that are heated, defogging the rear window (1).

The rear window (1) comprises antenna traces (A) (illustrated with a broken line in the figures) applied on the internal side of the glass plate (2). According to the invention, the antenna traces (A) are obtained by means of spray-coating of transparent nanowires on the glass plate (2), as illustrated above.

In FIG. 5, the antenna traces (A) comprise intersecting traces (5) and separate traces (6).

The intersecting traces (5) intersect the horizontal heating lines (4). The intersecting traces (5) are orthogonal to the horizontal heating lines (4) and intersect all the horizontal heating lines.

The separate traces (6) are disposed on the internal side of the glass plate (2) above the heater (H), forming a pattern, for example an "S"-shape (60) with vertical traces (61) that intersect the "S"-shape (60).

One end of the separate traces (6) is connected to a pad (7) applied on the side of the glass plate, usually the one that is not exposed to the external environment. The pad (7) can be made with transparent nanowires.

The pad (7) is electrically connected to an electronic component, such as an amplifier or impedance adapter that consists in a chip crimped or glued to the pad (7).

The intersecting traces (5) and the separate traces (6) are obtained by means of spray-coating of transparent nanowires. It must be considered that the intersecting traces (5) intersect the horizontal heating lines (4), but this is not a problem for the spray-coating of nanowires.

It must be considered that the intersecting traces (5) have a width of 1 mm, a thickness of 5-10 nm, and a length of 20-100 cm. Said intersecting traces (5) can be obtained by means of the nozzle (N) disclosed in FIG. 1.

The separate traces (6) can be easily obtained with the nozzle (N) of FIG. 1.

Figure 6:
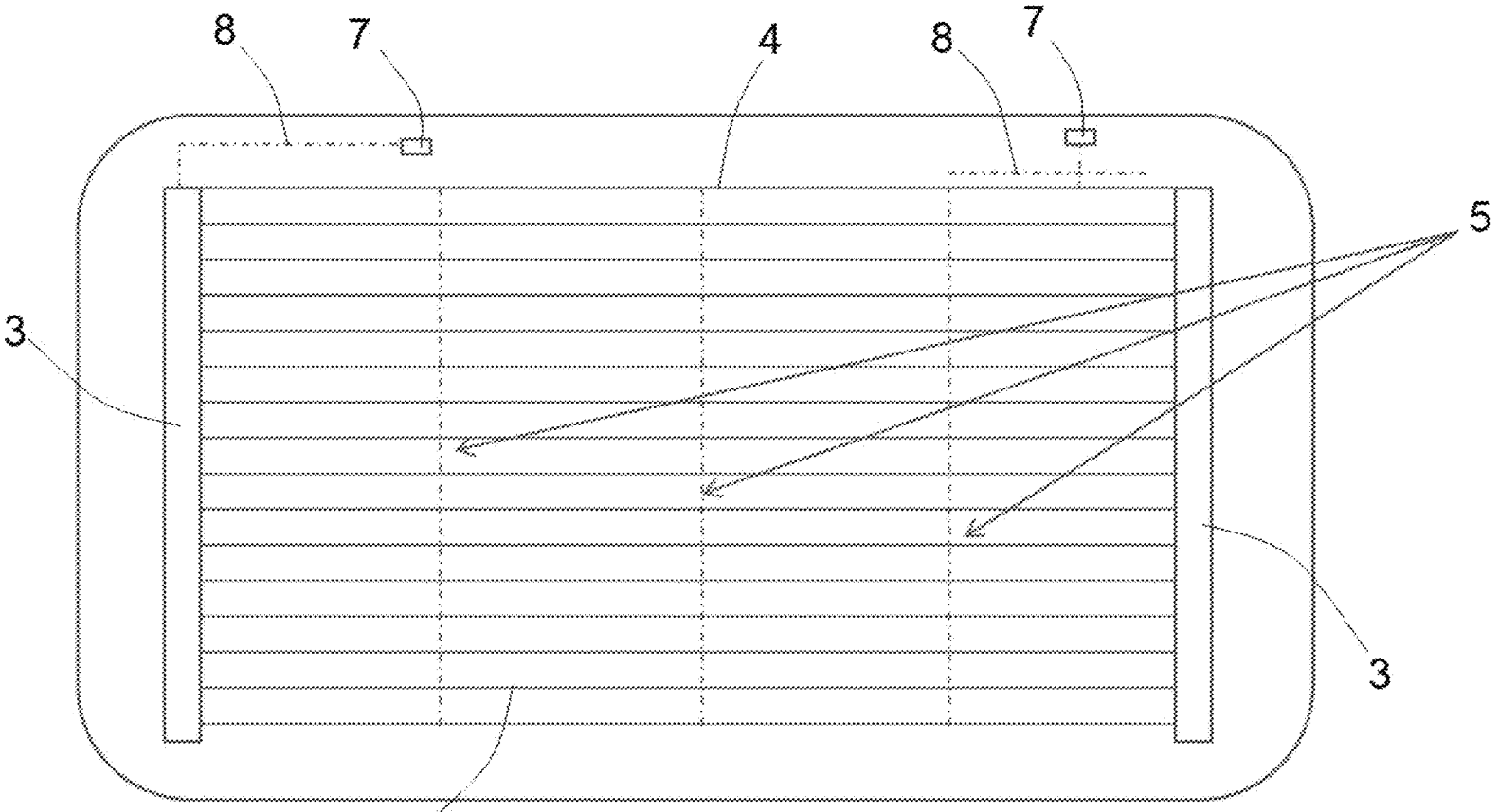

FIG. 6 illustrates an example wherein the antenna traces (A) comprise direct coupling traces (8), disposed in the plate (2) above the heater, in addition to the intersecting traces (5). A first direct coupling trace (8) is connected to a pad (7) and to a bus bar (3). A second direct coupling trace (8) is connected to a pad (7) and a horizontal heating line (4), such as the highest horizontal heating line.

The pads (7) are disposed in an upper region of the internal side of the plate and are suitable for being electrically connected to electronic components.

Also in such a case, the direct coupling traces (8) are obtained by means of spray-coating of transparent nanowires directly on the plate (2). The width and thickness of the direct coupling traces (8) are identical to the ones of the intersecting traces (5) and of the separate traces (6).

Figure 7:
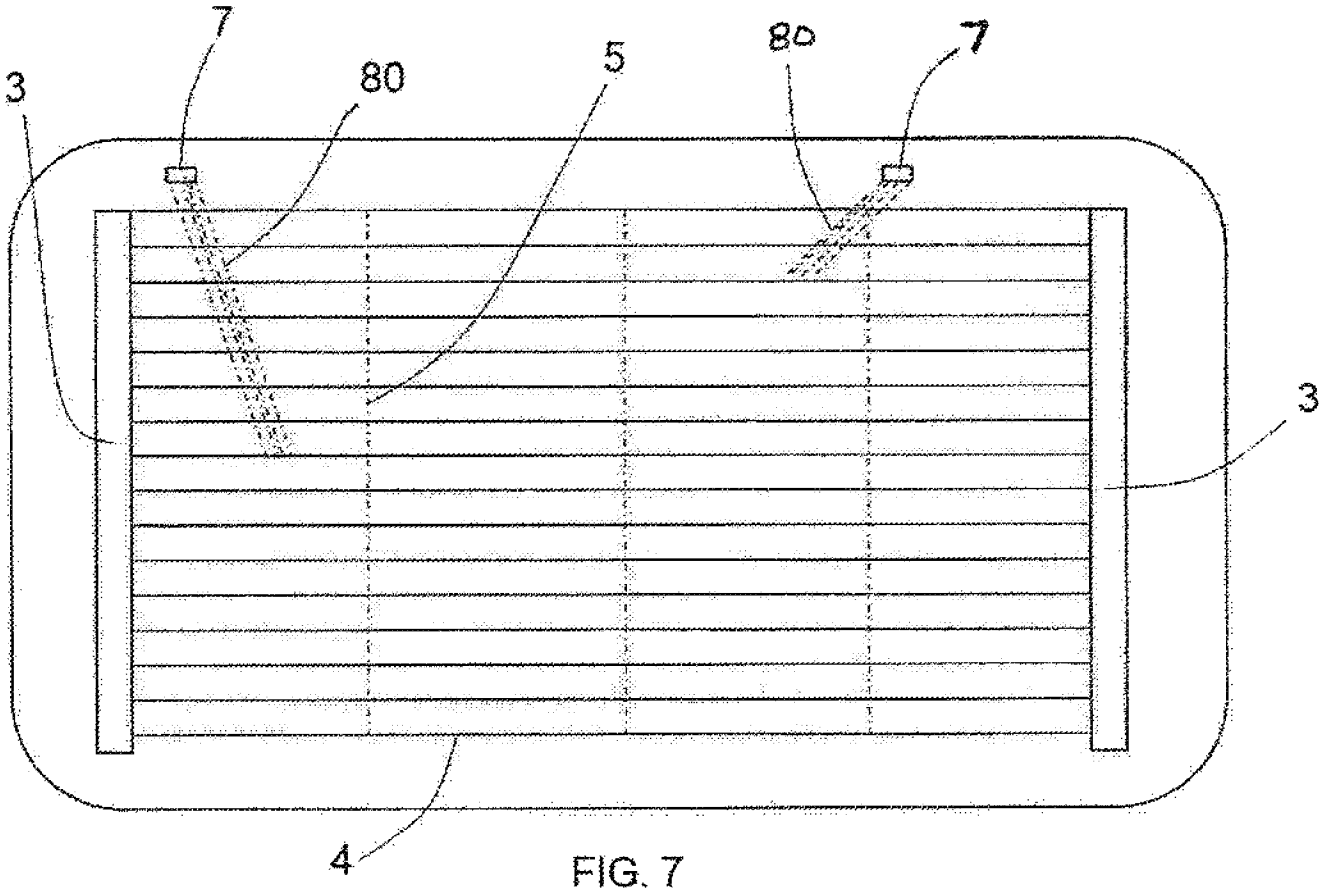

FIG. 7 illustrates an example of rear window wherein the antenna traces (A) comprise direct coupling intersecting traces (80) connected to pads (7) that are disposed on the plate (2) on the outside of the heater, intersecting one or more horizontal heating lines (4). Advantageously, the direct coupling intersecting traces (80) intersect the horizontal heating lines (4) with an angle other than 90°, for example an angle comprised between 60° and 80°.

The intersecting direct coupling traces (80) are realized with transparent nanowires technology, which permits to obtain a wide direct coupling band because the transparent nanowires have a controlled impedance value in order not to deviate the current flow that must only flow along the horizontal heating lines (4).

Figure 8:
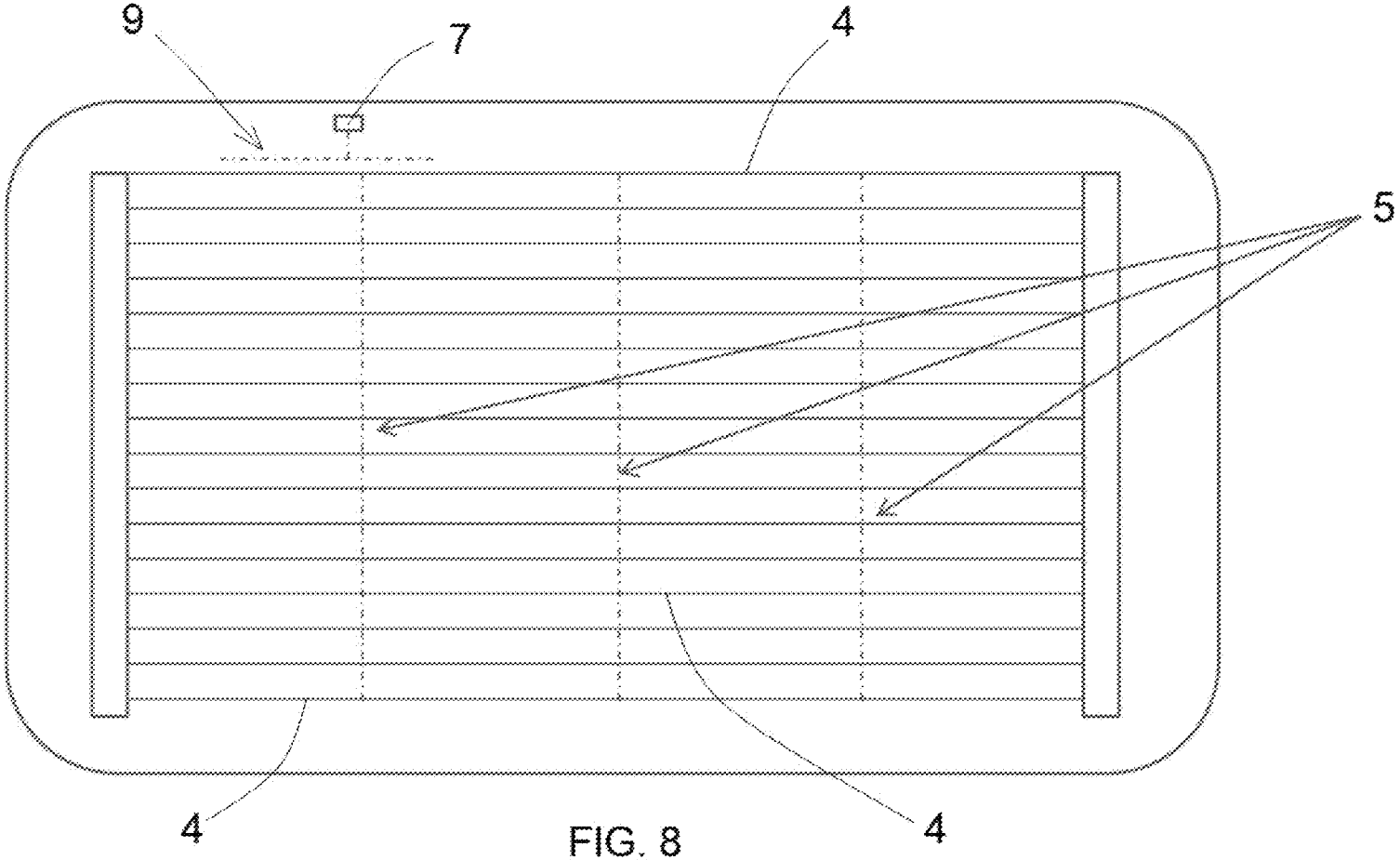

FIG. 8 illustrates an example wherein, in addition to the intersecting traces (5), the antenna traces (A) also comprise a capacitive coupling trace (9) disposed in the internal side of the plate (2) above the heater, in proximal parallel position to the highest horizontal heating line (4). The capacitive coupling trace (9) is connected to a pad (7) disposed in an upper region of the internal side of the plate and suitable for being electrically connected to electronic components, such as an amplifier or an impedance adapter.

Also in this case, the capacitive coupling trace (9) is obtained by spray-coating of transparent nanowires directly on the plate (2) and its wide and thickness are identical to the ones of the direct coupling traces (8, 80) of the intersecting traces (5) and of the separate traces (6).

It must be considered that, by using the spray-coating technology of transparent nanowires, the capacitive coupling trace (9) can be disposed in very proximal position to the horizontal heating line (4), for example at a distance lower than 8 mm, preferably lower than 5 mm, obtaining a better capacitive coupling than the prior art, wherein the capacitive coupling trace is at a distance higher than 8 mm from the horizontal heating line.

Figure 9A:
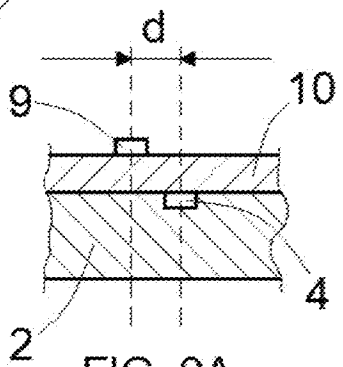

With reference to FIGS. 9 and 9A, the capacitive coupling trace (9) can be advantageously obtained by spray coating of transparent nanowires on a transparent oxide layer (10) (shown in grey in FIG. 9) deposited on the internal side of the glass plate (2).

The transparent oxide layer (10) is deposited on the horizontal heating line (4). As shown in FIG. 9A, a horizontal gap (d), in cross-section, lower than 8 mm, preferably lower than 5 mm, is provided between the capacitive coupling trace (9) and the horizontal heating line (4).

The capacitive coupling trace (9) is staggered relative to the horizontal heating line (4) whereon the transparent oxide layer (10) is applied, in such a way to define the horizontal gap (d) between an axis of the horizontal heating line (4) and an axis of the capacitive coupling trace (9). The horizontal gap (d) is lower than 5 mm and the transparent oxide layer (10) has a thickness lower than 5 mm.

The transparent oxide layer (10) avoids an ion migration between the capacitive coupling trace (9) and the horizontal heating line (4).

FIG. 9 illustrates a capacitive coupling trace (109) disposed on a transparent oxide layer (10) in proximal parallel position to a bus bar (3). In such a case, the transparent oxide layer (10) has an L-shape. The capacitive coupling trace (109) near the bus bar is connected to the capacitive coupling trace (9) that provides the coupling with the horizontal heating line (4).

FIGS. 10 and 10A illustrate an example wherein the capacitive coupling trace (9) is obtained by means of spray-coating on the transparent oxide layer (10) and is disposed in registered overlapped position relative to the horizontal heating line (4), i.e. with zero horizontal gap in cross-section. In view of the above, a vertical gap (s) is defined between the horizontal heating line (4) and the capacitive coupling line (9) that is equal to the thickness of the transparent oxide layer (10). Advantageously, the thickness of the transparent oxide layer (10) is lower than 5 mm.

Such a solution guarantees an efficacious capacitive coupling without any ion migration between the capacitive coupling trace (9) and the horizontal heating line (4).

Figure 11:
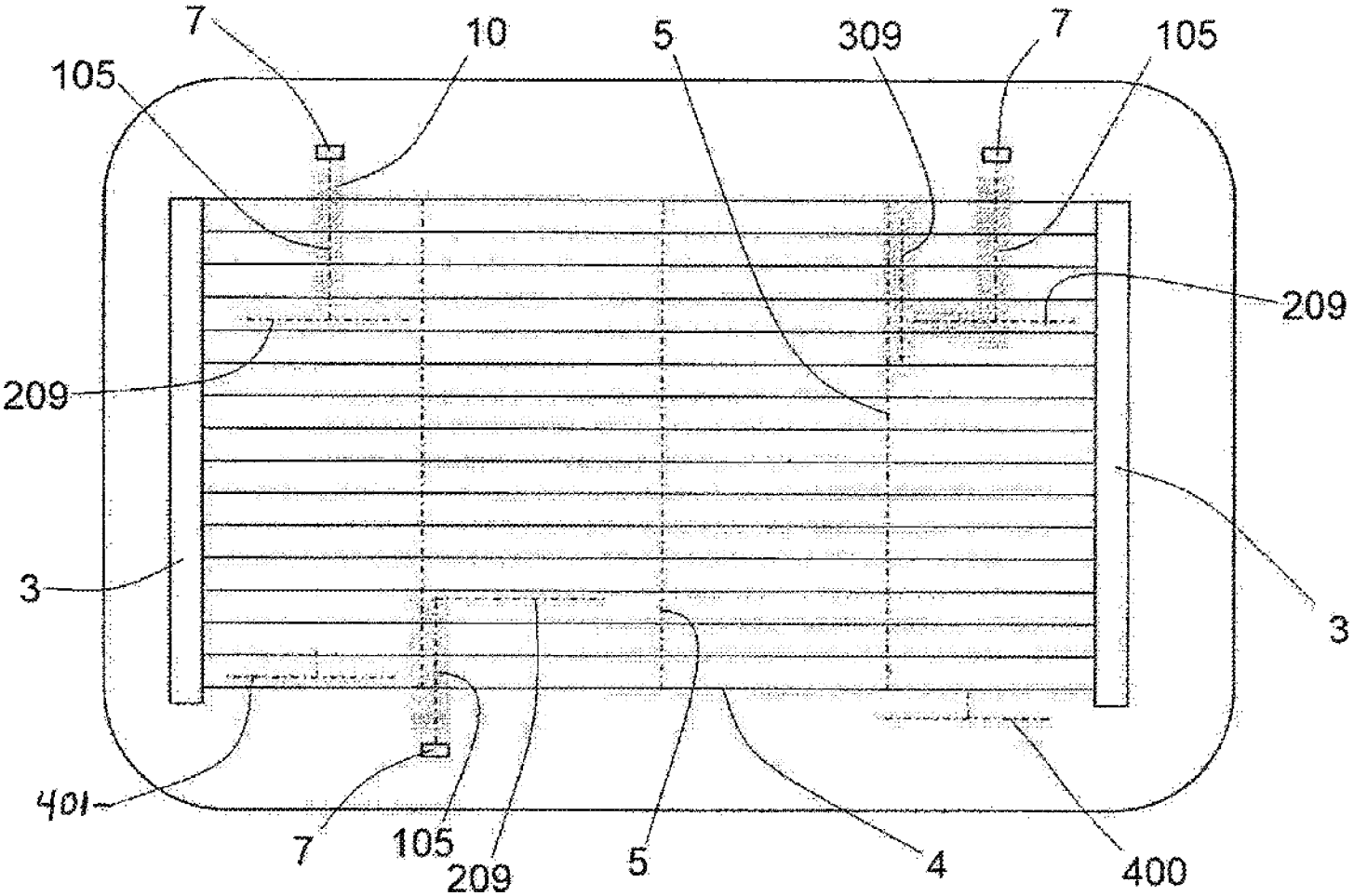

FIG. 11 illustrates internal capacitive coupling traces (209) disposed inside the heater (H), as horizontal lines between two horizontal heating lines (4). The internal capacitive coupling traces (209) are connected to pads (7) disposed on the plate (2) on the outside of the heater by means of connecting traces (105) that cross the horizontal heating lines (4).

The rear window (1) also comprises capacitive internal traces (309) in vertical position which cross multiple horizontal heating lines and are coupled with the intersecting traces (5).

The rear window (1) also comprises:

external stubs (400) disposed on the plate (2) on the outside of the heater and connected to a horizontal heating line (4); and internal stubs (401) disposed on the plate (2) on the inside of the heater, between two horizontal heating lines (4) and connected to a horizontal heating line (4).

Figure 12:
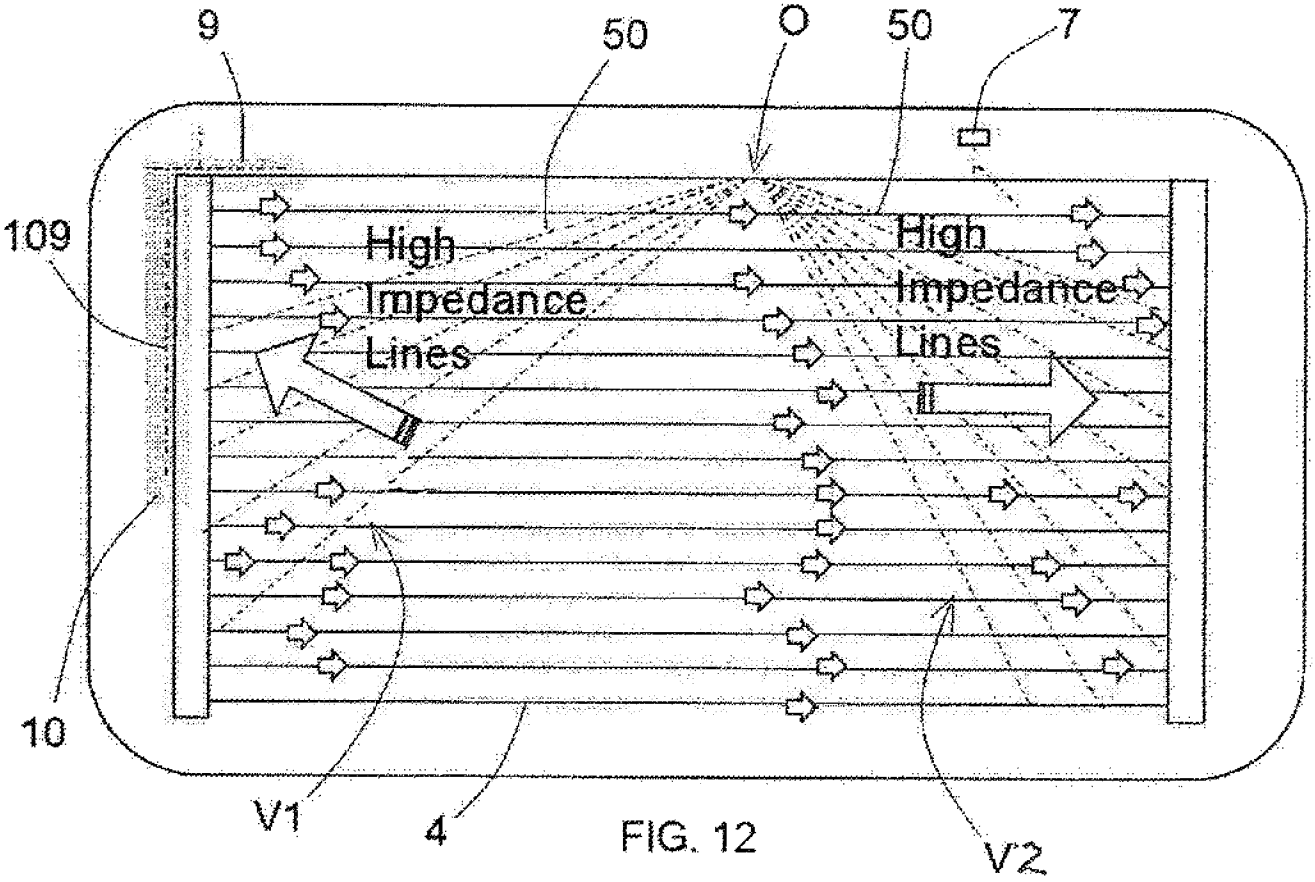

FIG. 12 illustrates a rear window wherein the antenna traces (A) comprise oblique intersecting lines (50) that intersect multiple horizontal heating lines in oblique direction, for example with angles comprises between 30° and 50°.

Said oblique intersecting traces (50) are disposed according to two fan-like configurations (V1, V2) with origin (O) in a central section of the horizontal heating line (4) disposed at a higher height.

The oblique intersecting traces (50) are realized with high impedance nanowires in order not to deviate the current flows from the horizontal heating lines (4).

Figure 13:
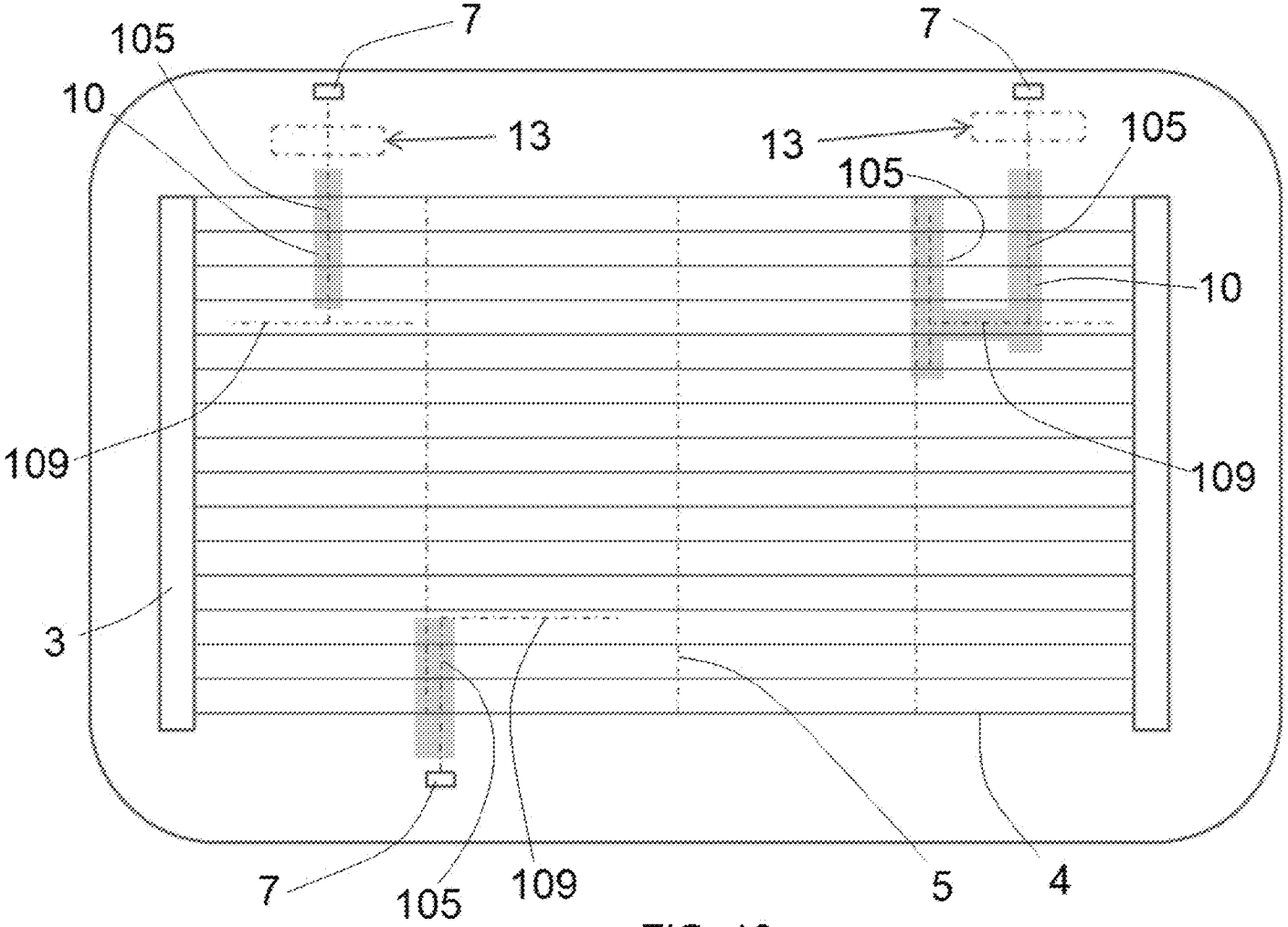

FIG. 13 illustrates an example of rear window, wherein the connection traces (105) are connected to a capacitive coupling trace (109) and to a planar adaptation structure (13) disposed on the plate (2) on the outside of the heater. The planar adaptation structure (13) is connected to a pad (7) disposed on the plate (2).

FIGS. 13A, 13B and 13C illustrate three examples of planar adaptation structures. The planar adaptation structures are transformers or stubs of concentrated inductance and capacity type.

The planar adaptation structures (13) are obtained by means of spray coating of transparent nanowires.

Figure 14:
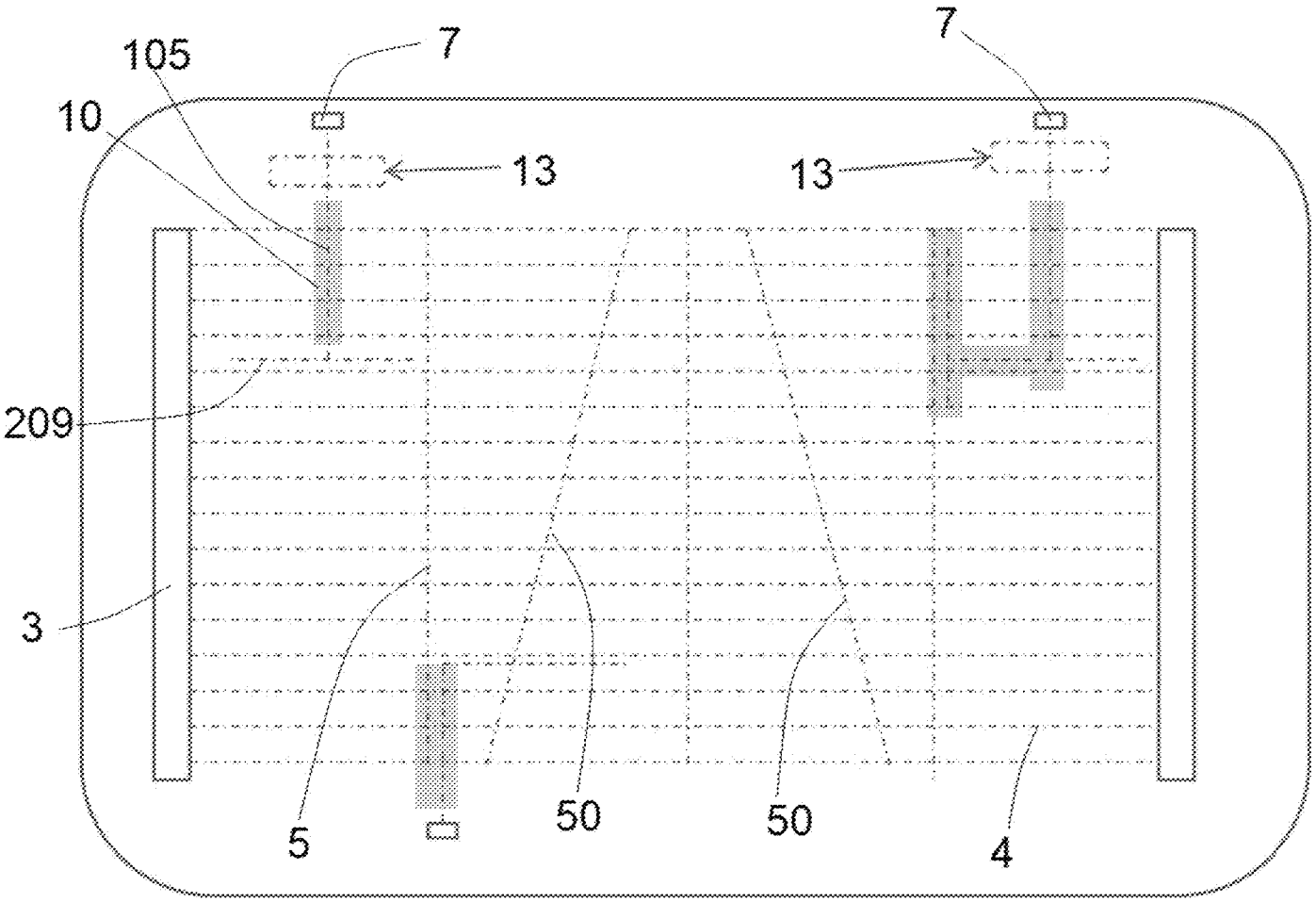

FIG. 14 illustrates an example of rear window wherein the horizontal heating lines (4) of the heater are obtained by means of spray coating with transparent nanowires and for this reason are shown with a broken line.

Although FIGS. 5 to 14 illustrate different examples of heater, with different types and layouts of the antenna traces (A), said types and layout of antenna traces can be combined one with another.

The invention claimed is:

1. A process for manufacturing a rear window of a vehicle, the process comprising:

forming a glass plate with an external side adapted to being directed toward an exterior of the vehicle and an internal side adapted to being directed toward an interior of the vehicle;

applying heat from a heater on the internal side of the glass plate, the heater having a pair of busbars electrically connected to a positive pole and a negative pole of a battery of the vehicle, the heater having a plurality of horizontal heating lines connecting the pair of busbars; and applying antenna traces by spray-coating on the internal side of the glass plate, the spray-coating comprising:

preparing a printing ink having transparent nanowires;

preparing the internal side of the glass plate by cleaning or plasma activation;

positioning and aligning a printing mask on the internal side of the glass plate;

spray-coating the printing ink onto the printing mask and the internal side of the glass plate so as to directly trace the antenna traces; and post-treating the glass plate thermally or optically.

2. The process of claim 1, further comprising:

applying a transparent oxide layer by spray-coating on the internal side of the glass plate; and applying the antenna traces by spray-coating onto the transparent oxide layer, the antenna traces having capacitive coupling traces, wherein the transparent oxide layer is applied on a horizontal heating line and the capacitive coupling traces are disposed in proximal parallel relation to the horizontal heating line.

3. The process of claim 2, wherein the capacitive coupling traces overlap the horizontal heating line on which the transparent oxide layer is applied so as to define a vertical gap between the horizontal heating line and the capacitive coupling traces, the vertical gap being equal to a thickness of the transparent oxide layer, the transparent oxide layer having a thickness less than five millimeters.

4. The process of claim 2, wherein the capacitive coupling traces are staggered with respect to the horizontal heating line on which the transparent oxide layer is applied so as to define a horizontal gap between an axis of the horizontal heating line and an axis of the capacitive coupling traces, the horizontal gap being less than five millimeters, the transparent oxide layer having a thickness of less than five millimeters.

5. The process of claim 1, further comprising:

spray-coating the transparent nanowires of conductive material on a side of the glass plate so as to form the pair of busbars and the plurality of horizontal heating lines of the heater.

6. The process of claim 1, the transparent nanowires being silver nanowires.

7. The process of claim 1, the transparent nanowires being copper nanowires.

8. The process of claim 1, the transparent nanowires being PEDOT:PSS.

9. The process of claim 1, the transparent nanowires being carbon nanotubes.

10. The process of claim 1, wherein the transparent nanowires of the antenna traces each have a thickness of between five nanometers and ten nanometers.

11. The process of claim 1, wherein the step of applying antenna traces comprising:

applying the transparent nanowires with only one layer of the spray-coating.

12. The process of claim 5, wherein the transparent nanowires for the pair of busbars each have a thickness of between 30 nanometers and 50 nanometers.

13. The process of claim 5, wherein the transparent nanowires for the pair of busbars are applied with a plurality of layers of the spray-coating.

14. The process of claim 1, wherein the antenna traces have intersecting traces that intersect the plurality of horizontal heating lines and separate traces that do not intersect the heater.

15. The process of claim 1, wherein the antenna traces comprise direct coupling traces connected to one of the pair of busbars or one of the plurality of horizontal heating lines.

16. The process of claim 1, wherein the antenna traces comprise capacitive coupling traces in parallel relation to one of the plurality of horizontal heating lines or to one of the pair of busbars, the rear window having at least one planar adaptation structure connected to the capacitive coupling traces, the at least one planar adaptation structure formed by spray-coating strips of transparent conductive material on the internal side of the glass plate.

* * * * *